US005950870A

United States Patent [19]

Takenaka

[11] Patent Number: 5,950,870

[45] Date of Patent: Sep. 14, 1999

[54] DRINK DISPENSER

[75] Inventor: Katsumi Takenaka, Mie, Japan

[73] Assignee: Fuji Electric Co., Ltd., Kawasaki, Japan

[21] Appl. No.: 08/965,489

[22] Filed: Nov. 6, 1997

[30] Foreign Application Priority Data

Nov. 11, 1996 [JP] Japan ..... 8-298289

[51] Int. Cl.[6] ..... B67D 1/00

[52] U.S. Cl. ..... 222/52; 222/129.1; 222/129.3; 222/640

[58] Field of Search ..... 222/52, 61, 63, 222/129.1, 129.3, 639–641

[56] References Cited

U.S. PATENT DOCUMENTS 3,145,741 8/1964 Smith ..... 222/641
5,062,555 11/1991 Whigham et al. ..... 222/641
5,129,548 7/1992 Wisniewski ..... 222/641
5,141,130 8/1992 Wiley et al. ..... 222/129.1
5,454,406 10/1995 Rejret et al. ..... 222/641
5,601,218 2/1997 Takenaka ..... 222/641

*Primary Examiner*—J. Casimer Jacyna
*Attorney, Agent, or Firm*—Kanesaka & Takeuchi

[57] ABSTRACT

A drink dispenser includes a continuous supply/stop button that requests a sale of a drink to be suspended when it is pressed during the sale and further requests a drink to be continuously supplied when it is pressed while no drink is being sold, and a mode switch for changing between enabled and disabled states of the continuous supply/stop button. When the continuous supply/stop button is pressed during the sale of a drink, the process is ended if the mode switch is on. Alternatively, when the continuous supply/stop button is pressed while no drink is being sold, the process is ended if the mode switch is on. In the drink dispenser, turning the mode switch on can invalidate a request from the continuous supply/stop button to prevent any inconveniences caused by any improper operation of the button.

15 Claims, 7 Drawing Sheets

DRINK DISPENSER

BACKGROUND OF THE INVENTION AND RELATED ART STATEMENT

The present invention relates to a controller for a drink dispenser for selling a specified amount of a drink when a specified-amount sale button is pressed.

Conventional drink dispensers for selling a specified amount of a drink include specified-amount sale buttons, and when one of these buttons is pressed by a user, a specified amount of the corresponding drink is sold.

A continuous supply/stop button mainly used to set the amount of a drink is installed near the specified-amount sale button. When the continuous supply/stop button is pressed during the sale of a drink, the sale of the drink is suspended, whereas when the button is pressed while no drink is being sold, the corresponding drink is continuously supplied as long as the button is held down.

Conventional controllers for drink dispensers have the following problems.

The continuous supply/stop button serves a function which is required to set the amount of a drink to be sold but is rarely used during a normal sale. The function of this button, however, is enabled even during a normal sale. Thus, if only the specified-amount sale is used, when this button is pressed, the supply of a drink is suspended during that sale or the drink is mistakenly continuously supplied. Consequently, drinks are supplied inefficiently and waste occurs.

When the function of the continuous supply/stop button is disabled, the sale of this drink can not be suspended quickly no matter whether any drink is being sold or not, for example, if a type of drink is mistakenly selected.

An object of this invention is to limit the function of the continuous supply/stop button to prevent improper operations and to improve the operability of this button.

SUMMARY OF THE INVENTION

According to a first aspect of the invention, a drink dispenser for selling a specified amount of a drink comprises drink sale instruction means for selecting a type of a drink and instructing its sale; sale detection means for detecting whether or not any drink is being sold; continuous supply/stop request means for requesting the sale of a drink to be suspended when it is operated during the sale and for requesting a drink to be continuously supplied when it is operated while no drink is being sold; drink supply means for suspending the sale of a drink or continuously supplying a drink upon a request from the continuous supply/stop request means; and switching means for determining whether or not a request from the continuous supply/stop request means is to be invalidated, wherein when the continuous supply/stop request means issues a request, this request is not accepted if the switching means is turned on.

Thus, by turning the switching means on, a sale is not suspended even if the continuous supply/stop request means issues a request during that sale, and a drink is not continuously supplied even if the continuous supply/stop request means issues a request while no drink is being sold. Thus, the function of the continuous supply/stop button is limited to prevent any inconveniences caused by any improper operation of the continuous supply/stop request means.

According to a second aspect of the invention, a drink dispenser for selling a specified amount of a drink comprises drink sale instruction means for selecting a type of a drink and instructing its sale; sale detection means for detecting whether or not any drink is being sold; continuous supply/stop request means for requesting the sale of a drink to be suspended when it is operated during that sale and for requesting a drink to be continuously supplied when it is operated while no drink is being sold; drink supply means for suspending the sale of a drink or continuously supplying a drink upon a request from the continuous supply/stop request means; and switching means for determining whether or not a request from the continuous supply/stop request means is to be invalidated, wherein when the continuous supply/stop request means issues a request during the sale of a drink, this request is accepted, whereas when the request means issues a request while no drink is being sold, this request is not accepted if the switching means is turned on.

Thus, if the continuous supply/stop request means issues a request during the sale of a drink, that sale is suspended whether or not the switching means is turned on, whereas even if the continuous supply/stop request means issues a request while no drink is being supplied, the continuous supply of a drink is prevented by turning the switching means on. This invention thus enables the sale of a drink to be suspended when the drink is mistakenly selected, and prevents any inconveniences caused by any improper operation of the continuous supply/stop request means while no drink is being sold.

According to a third aspect of the invention, a drink dispenser for selling a specified amount of a drink comprises drink sale instruction means for selecting a type of a drink and instructing its sale; sale detection means for detecting whether or not any drink is being sold; continuous supply/stop request means for requesting the sale of a drink to be suspended when it is operated during that sale and for requesting a drink to be continuously supplied when it is operated while no drink is being sold; drink supply means for suspending the sale of a drink or continuously supplying a drink upon a request from the continuous supply/stop request means; and switching means for determining whether or not a request from the continuous supply/stop request means is to be invalidated; and set mode detection means for detecting whether or not the dispenser is in a set mode, wherein when the continuous supply/stop request means issues a request, this request is not accepted if the dispenser is not in the set mode and if the switching means is turned on.

Thus, during a mode other than the set mode, by turning the switching means on, a sale is not suspended even if the continuous supply/stop request means issues a request during the sale of a drink, whereas the continuous supply of a drink is prevented even if the continuous supply/stop request means issues a request while no drink is being sold. Thus, the function of the continuous supply/stop button is limited to prevent any inconveniences caused by any improper operation of the continuous supply/stop request means.

According to a fourth aspect of the invention, a drink dispenser for selling a specified amount of a drink comprises drink sale instruction means for selecting a type of a drink and instructing its sale; sale detection means for detecting whether or not any drink is being sold; continuous supply/stop request means for requesting the sale of a drink to be suspended when it is operated during that sale and requesting a drink to be continuously supplied when it is operated while no drink is being sold; drink supply means for suspending the sale of a drink or continuously supplying a drink upon a request from the continuous supply/stop request means; switching means for determining whether or not a request from the continuous supply/stop request means is to be invalidated; and set mode detection means for detecting whether or not the dispenser is in a set mode, wherein when the continuous supply/stop request means issues a request during the sale of a drink, this request is accepted, whereas when the request means issues a request while no drink is being sold, this request is not accepted if the dispenser is not in the set mode and if the switching means is turned on.

Thus, if the continuous supply/stop request means issues a request during the sale of a drink, that sale is suspended despite the set mode and whether or not the switching means is turned on, whereas even if the continuous supply/stop request means issues a request while no drink is being supplied, the continuous supply of a drink is prevented by turning the switching means on when the apparatus is not in the set mode. This invention thus enables the sale of a drink to be suspended when the drink is mistakenly selected, even during the sale of a drink, and prevents any inconveniences caused by any improper operation of the continuous supply/stop request means while no drink is being sold.

According to a fifth aspect of the invention, a drink dispenser for selling a specified amount of a drink comprises drink sale instruction means for selecting a type of a drink and instructing its sale; sale detection means for detecting whether or not any drink is being sold; continuous supply/stop request means for requesting the sale of a drink to be suspended when it is operated during that sale and for requesting a drink to be continuously supplied when it is operated while no drink is being sold; drink supply means for suspending the sale of a drink or continuously supplying a drink upon a request from the continuous supply/stop request means; switching means for determining whether or not a request from the continuous supply/stop request means is to be invalidated; and mode detection means for detecting whether the dispenser is in a mode other than a normal sale, wherein when the continuous supply/stop request means issues a request, this request is not accepted if the dispenser is in the normal sale mode and if the switching means is turned on.

Thus, by assuming that the set mode in the third aspect of the invention is a mode other than the normal sale mode in this invention, the function of the continuous supply/stop button can be similarly limited to prevent any inconveniences due to any improper operation of the continuous supply/stop request means.

According to a sixth aspect of the invention, a drink dispenser for selling a specified amount of a drink comprises drink sale instruction means for selecting a type of a drink and instructing its sale; sale detection means for detecting whether or not any drink is being sold; continuous supply/stop request means for requesting the sale of a drink to be suspended when it is operated during that sale and for requesting a drink to be continuously supplied when it is operated while no drink is being sold; drink supply means for suspending the sale of a drink or continuously supplying a drink upon a request from the continuous supply/stop request means; switching means for determining whether or not a request from the continuous supply/stop request means is to be invalidated; and mode detection means for detecting whether the dispenser is in a mode other than a normal sale mode, wherein when the continuous supply/stop request means issues a request during the sale of a drink, this request is accepted, whereas when the request means issues a request while no drink is being sold, this request is not accepted if the dispenser is in the normal sale mode and if the switching means is turned on.

Thus, by assuming that the set mode in the fourth aspect of the invention is a mode other than the normal sale mode in this invention, the sale of a drink is similarly suspended even during a sale when the drink is mistakenly selected, and any inconveniences caused by any improper operation of the continuous supply/stop request means are prevented while no drink is being sold.

According to a seventh aspect of the invention, in the drink dispenser according to the third aspect of the invention, when the continuous supply/stop request means issues a request, this request is accepted if the dispenser is in the set mode.

Thus, when the continuous supply/stop request means issues a request during the set mode, if a drink is being sold, the sale is suspended, whereas if no drink is being sold, a drink is continuously supplied no matter whether the switching means is turned on. As a result, the operations required during the set mode are provided without switching the switching means, thereby improving the usability of the continuous supply/stop request means.

According to an eighth aspect of the invention, in the drink dispenser according to the fifth aspect of the invention, when the continuous supply/stop request means issues a request, this request is accepted if the dispenser is in a mode other than the normal sale mode.

Thus, as in the seventh aspect of the invention, all required operations are provided during a mode other than the normal sale mode without switching the switching means, thereby improving the operability of the continuous supply/stop request means.

DETAILED DESCRIPTION OF PREFERRED EMBODIMENTS

Figure 1:
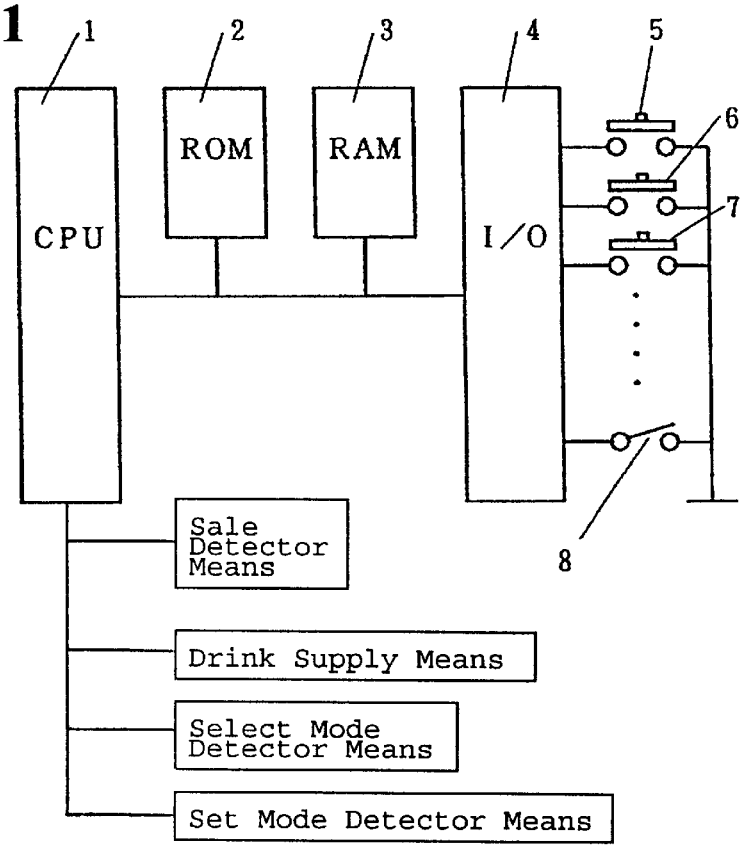
FIG. 1 is a block diagram showing the invention.

In FIG. 1, reference numeral 1 designates a CPU that controls the overall apparatus and to which an ROM 2 for storing a control program, an RAM 3 for storing various data and the specified amounts of sold drinks as a time for opening a drink discharge valve relay (not shown), and an I/O 4 for various devices are connected.

The I/O 4 is connected to an S-size specified-amount sale button 5, an M-size specified-amount sale button 6, and a continuous supply/stop button 7, for specifying the amount of a supplied drink for each type of drink, and a mode switch 8 for determining whether or not the continuous supply/stop button 7 will be enabled. When the button 7 is pressed during the sale of a drink, the continuous supply/stop button 7 requests the suspension of the sale, whereas when the button 7 is pressed while no drink is being sold, it requests the continuous supply of a drink.

Figure 2:
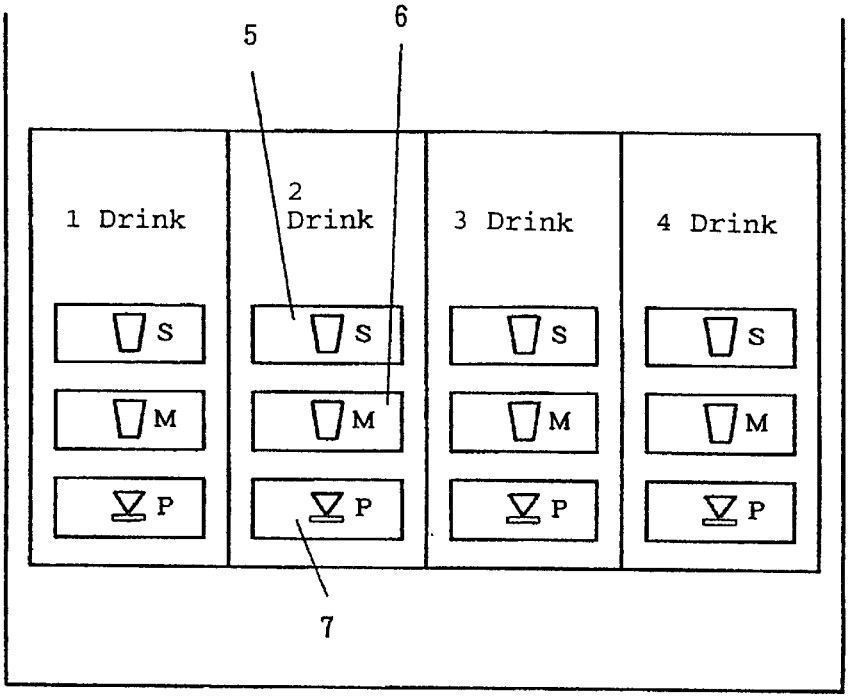
FIG. 2 shows an example of a layout of drink sale buttons in a drink dispenser of the invention.

FIG. 2 shows an example showing how drink sale buttons are installed in a drink dispenser. This drink dispenser sells four types of drinks including drinks 1 to 4 and includes for each drink the S-size specified-amount sale button 5, the M-size specified-amount sale button 6, and the continuous supply/stop button 7. When, for example, the S-size specified-amount sale button 5 corresponding to the drink 2 is pressed, an S-size specified amount of drink 2 is sold. In addition, when the continuous supply/stop button 7 is pressed while a specified amount of a drink is being sold or no drink is being sold, the sale of the drink is suspended or a drink is continuously supplied.

FIGS. 3 to 8 show flowcharts of the operation of each embodiment of the invention described below. Each operation is described with reference to FIGS. 1 and 2.

Figure 3:
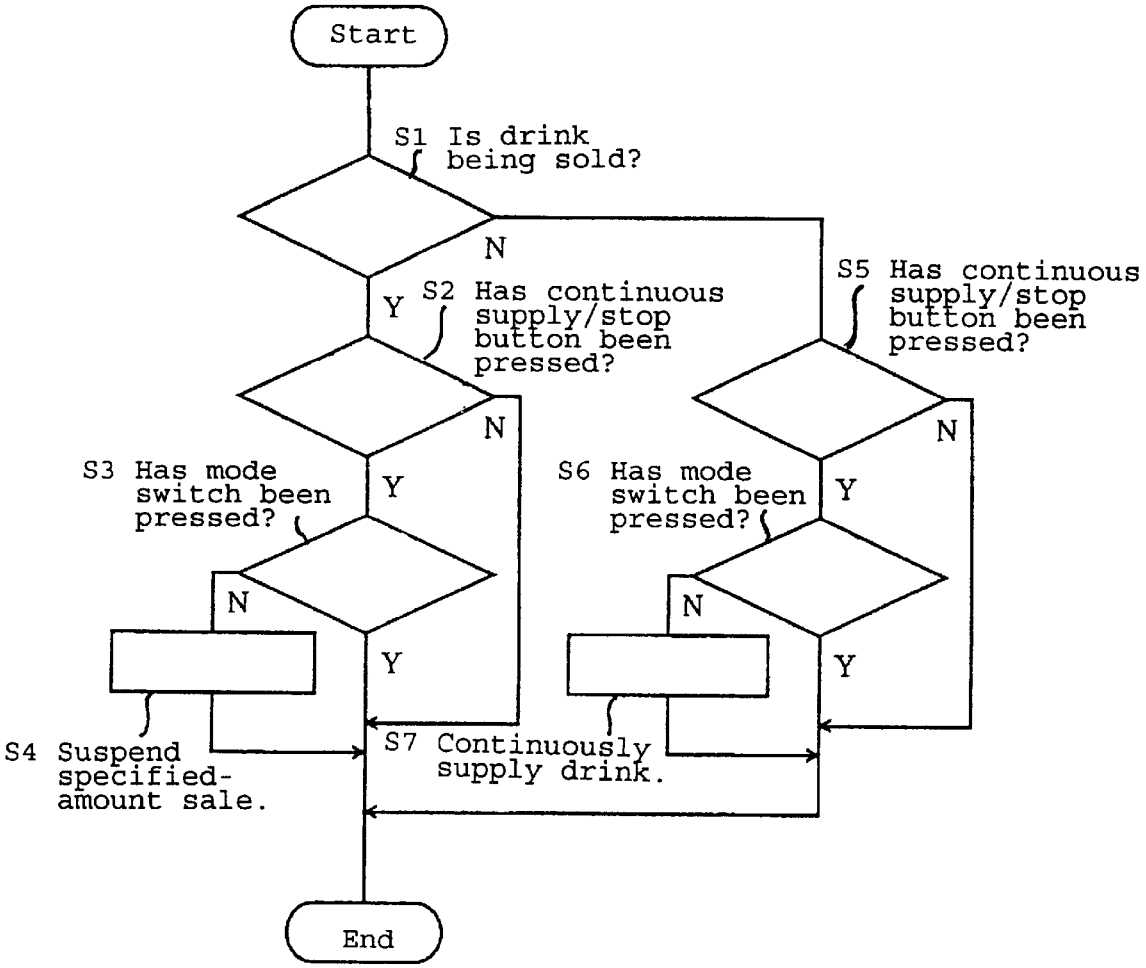
FIG. 3 is a flowchart showing the operation of the first embodiment of the invention.

First Embodiment of the Invention shown in FIG. 3

The CPU 1 determines from the operational condition of a drink supply apparatus (not shown) whether or not any drink is being sold (step S1).

When the continuous supply/stop button 7 is pressed (step S2, branch Y) during the sale of a drink (branch Y), the CPU determines whether or not the mode switch 8 is turned on (step S3). If not (branch N), the sale of a specified amount of the drink is suspended, that is, the request from the continuous supply/stop button 7 is accepted (step S4). Otherwise (branch Y), the process is ended to reject the request from the continuous supply/stop button 7. If the continuous supply/stop button 7 has not been pressed (step S2, branch N), the process is ended.

When the continuous supply/stop button 7 is pressed (step S5, branch Y) while no drink is being sold (step S1, branch N), the CPU determines whether or not the mode switch 8 is turned on (step S6). If not (branch N), the continuous supply of a drink is executed, that is, the request from the continuous supply/stop button 7 is accepted (step S7). Otherwise (branch Y), the process is ended to reject the request from the continuous supply/stop button 7. If the continuous supply/stop button 7 has not been pressed (step S5, branch N), the process is ended.

In the above operations, if the mode switch 8 is turned on, it is possible to invalidate a request from the continuous supply/stop button 7 for the suspension of a specified-amount sale during that sale, and a request from the same button for continuous supply issued while no drink is being sold. This configuration prevents any inconveniences caused by the improper operation of the continuous supply/stop button, such as the suspension of the sale of a drink and the continuous supply of a drink while no drink is being sold.

Figure 4:
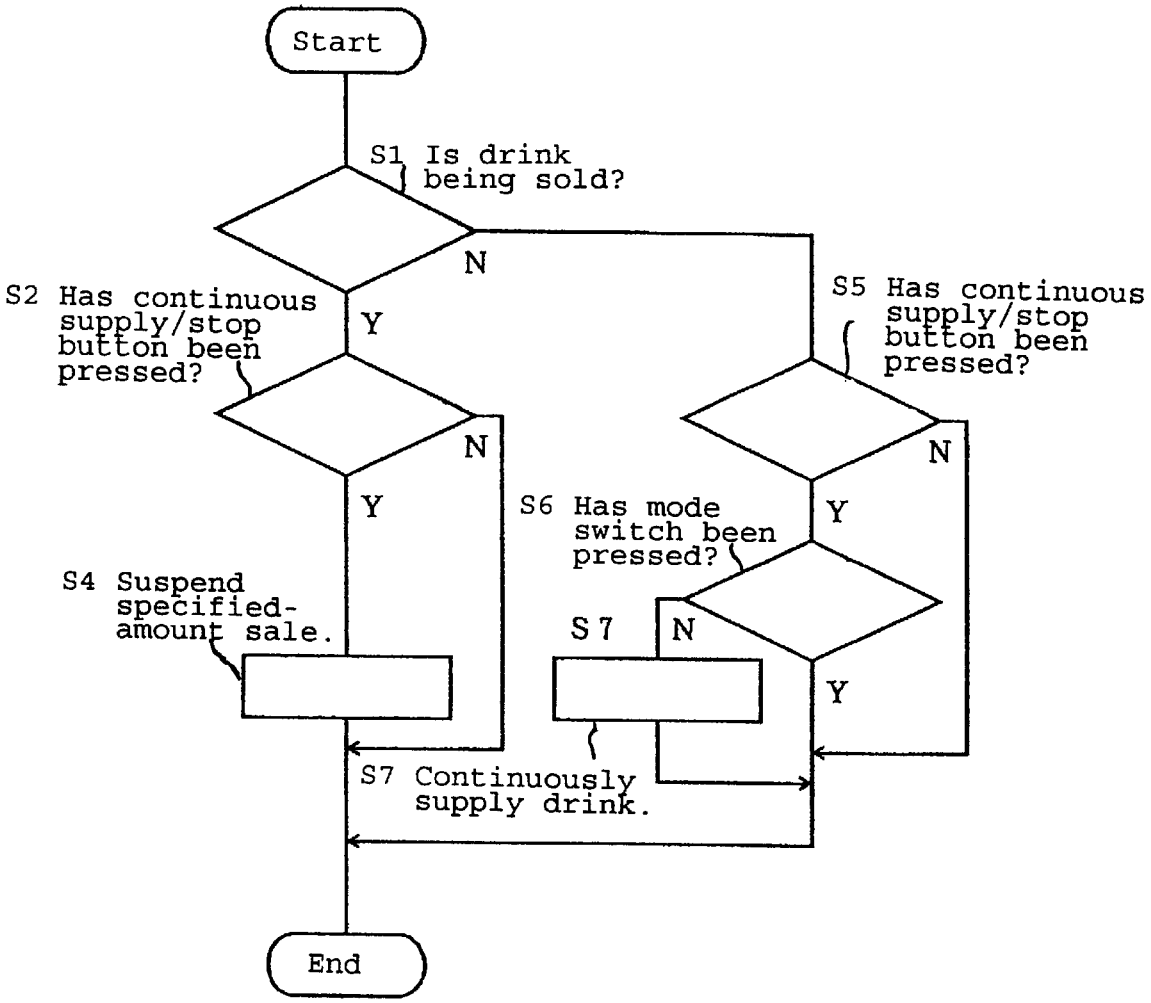
FIG. 4 is a flowchart showing the operation of the second embodiment of the invention.

Second Embodiment of the Invention shown in FIG. 4

This flowchart is the same as that for the first embodiment of the invention (FIG. 3), except that step S3 has been omitted.

When the continuous supply/stop button 7 is pressed (step S2, branch Y) during the sale of a drink (step S1, branch Y), the specified-amount sale is immediately suspended (step S4), that is, the request from the continuous supply/stop button 7 is accepted no matter whether the mode switch 8 is turned on. The other operations are the same as in the first embodiment of the invention.

In the above operations, turning the mode switch 8 on can invalidate a request from the continuous supply/stop button 7 for continuous supply issued while no drink is being sold and can always accept requests from the same button for the suspension of the specified-amount sale issued during that sale. Thus, for example, when a user has mistakenly pressed a specified-amount sale button different from the button corresponding to the desired type of drink and desires to suspend the sale of the drink immediately, the discharge of the drink can be suspended by pressing the continuous supply/stop button. This operation also prevents the continuous supply of a drink caused by any improper operation while no drink is being sold.

Figure 5:
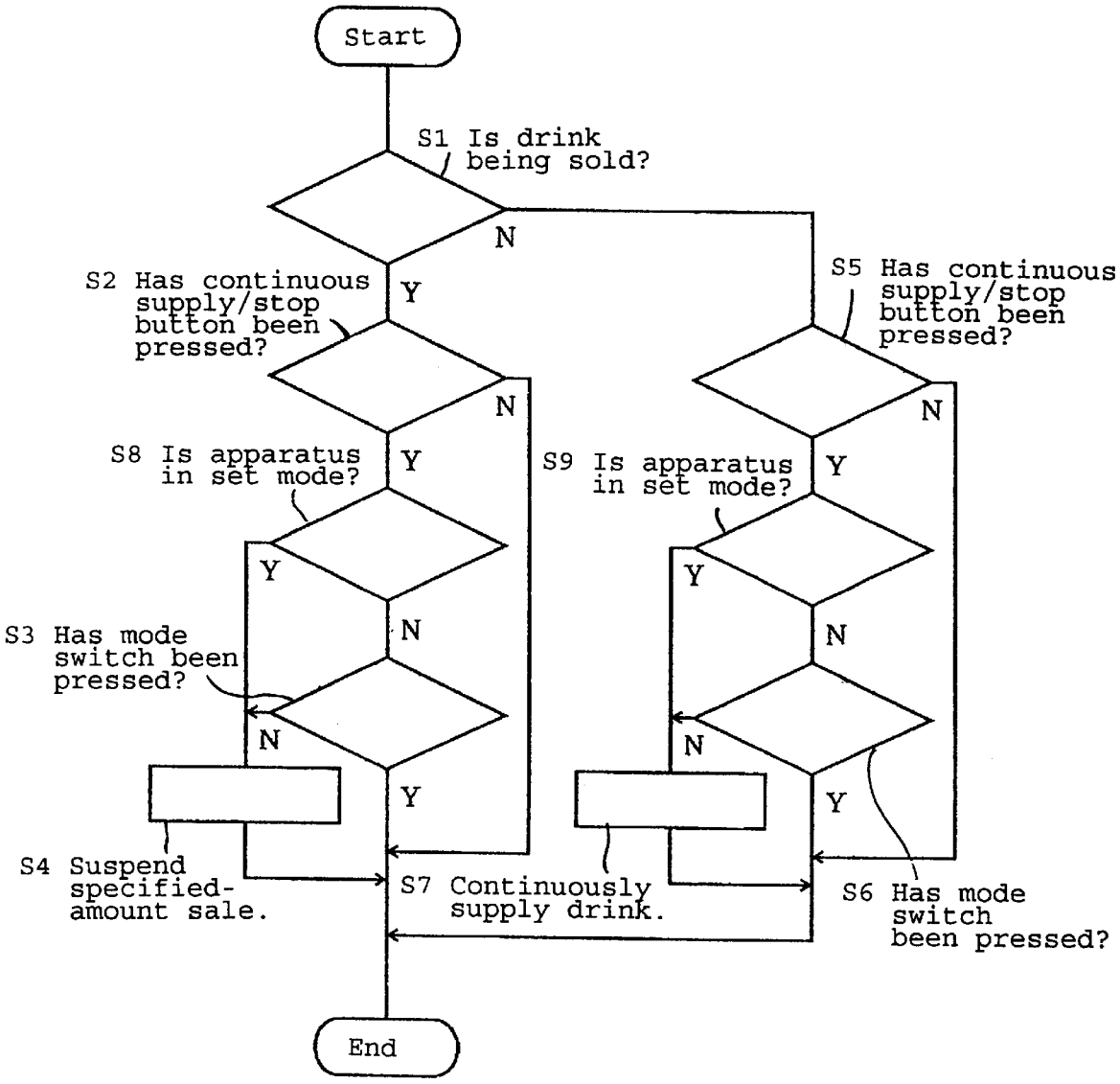
FIG. 5 is a flowchart showing the operation of the third embodiment of the invention.

Third Embodiment of the Invention shown in FIG. 5

This flowchart is the same as that for the first embodiment of the invention (FIG. 3) except that steps S8 and S9 for determining whether the apparatus is in a set mode (for example, adjusting the specified amount of a drink) have been inserted between steps S2 and S3 and steps S5 and S6, respectively.

When the continuous supply/stop button 7 is pressed (step S2, branch Y) during the sale of a drink (step S1, branch Y), the CPU determines whether or not the apparatus is in a set mode (step S8). If so (branch Y), the specified-amount sale is suspended to validate the set amount of a drink to be adjusted, that is, the request from the continuous supply/stop button 7 is accepted (step S4). Otherwise (branch N), the process proceeds to step S3.

When the continuous supply/stop button 7 is pressed (step S5, branch Y) while no drink is being sold (step S1, branch N), the CPU determines whether or not the apparatus is in a set mode (step S9). If so (branch Y), a drink is continuously supplied to validate the set amount of a drink to be adjusted, that is, the request from the continuous supply/stop button 7 is accepted (step S7). Otherwise (branch N), the process proceeds to step S6.

The other operations are the same as in the first embodiment of the invention.

In the above operations, when the apparatus is not in a set mode, turning the mode switch 8 on can limit the function of the continuous supply/stop button 7 to prevent any inconveniences caused by improper operations, as in the first embodiment of the invention. Furthermore, when the apparatus is in a set mode, the function of the continuous supply/stop button 7 is enabled no matter whether the mode switch 8 is turned on. Thus, if a user uses the continuous supply/stop button 7 to set the specified amount of a drink but does not desire to use it during normal drink sales, the mode switch 8 can be used to avoid switching between the enabled and disabled states of the continuous supply/stop button 7.

Figure 6:
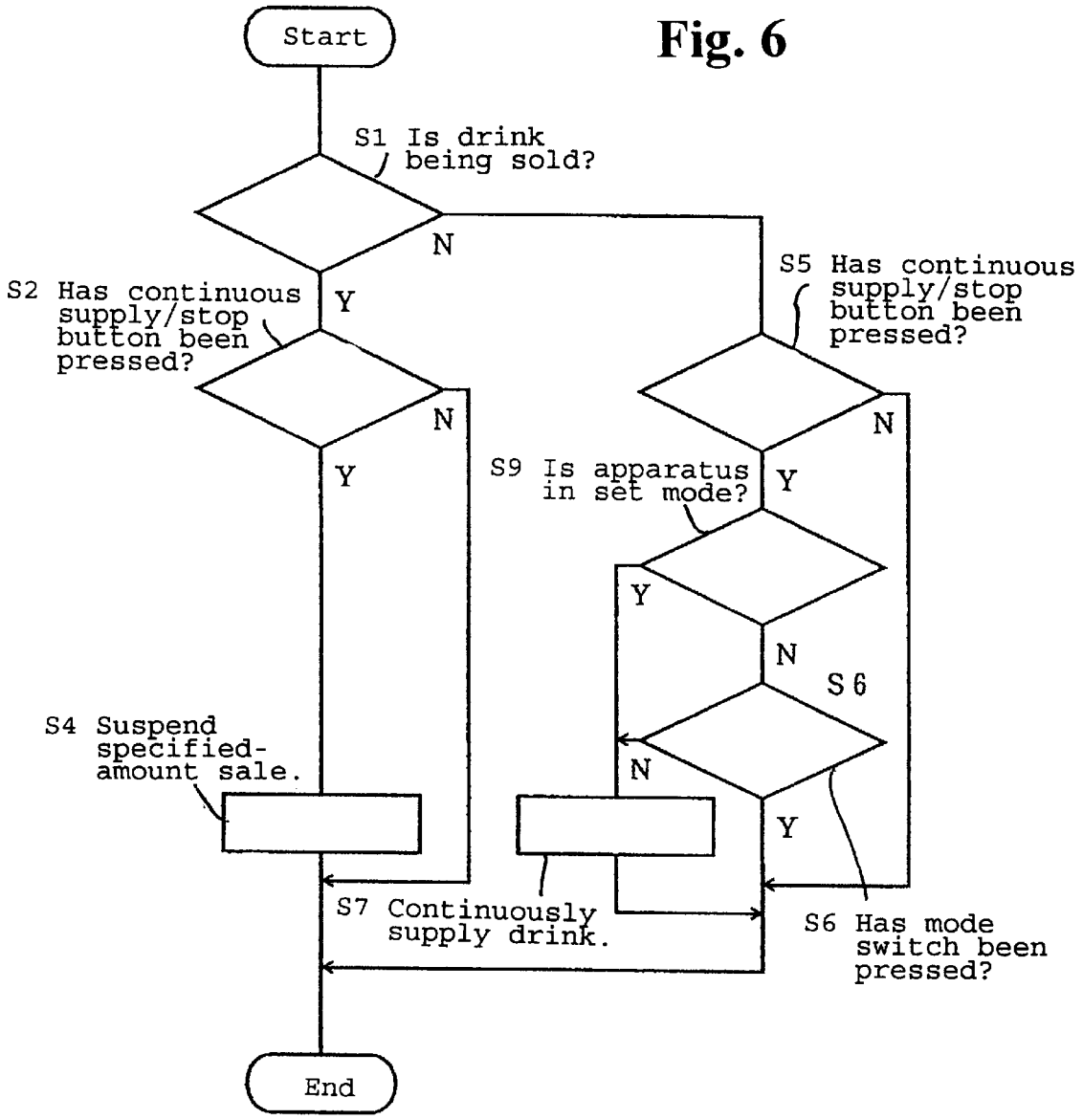
FIG. 6 is a flowchart showing the operation of the fourth embodiment of the invention;.

Fourth Embodiment of the Invention shown in FIG. 6

This flowchart is the same as that for the third embodiment of the invention (FIG. 5) except that steps S8 and S3 have been omitted.

When the continuous supply/stop button 7 is pressed (step S2, branch Y) during the sale of a drink (step S1, branch Y), the specified amount sale is suspended immediately (step S4), that is, the request from the continuous supply/stop button 7 is accepted no matter whether the mode switch 8 is turned on. The other operations are the same as in the third embodiment of the invention.

In the above operations, turning the mode switch 8 on can invalidate a request from the continuous supply/stop button 7 for continuous supply issued while no drink is being sold and when the apparatus is not in a set mode, and can always accept a request from the same button for the suspension of the specified-amount sale issued during that sale. Thus, for example, when a user has mistakenly pressed a specified-amount sale button different from the button corresponding to the desired type of drink and desires to suspend the sale of the drink immediately, the discharge of the drink can be suspended by pressing the continuous supply/stop button. This operation also prevents the continuous supply of a drink caused by any improper operation while no drink is being sold.

Figure 7:
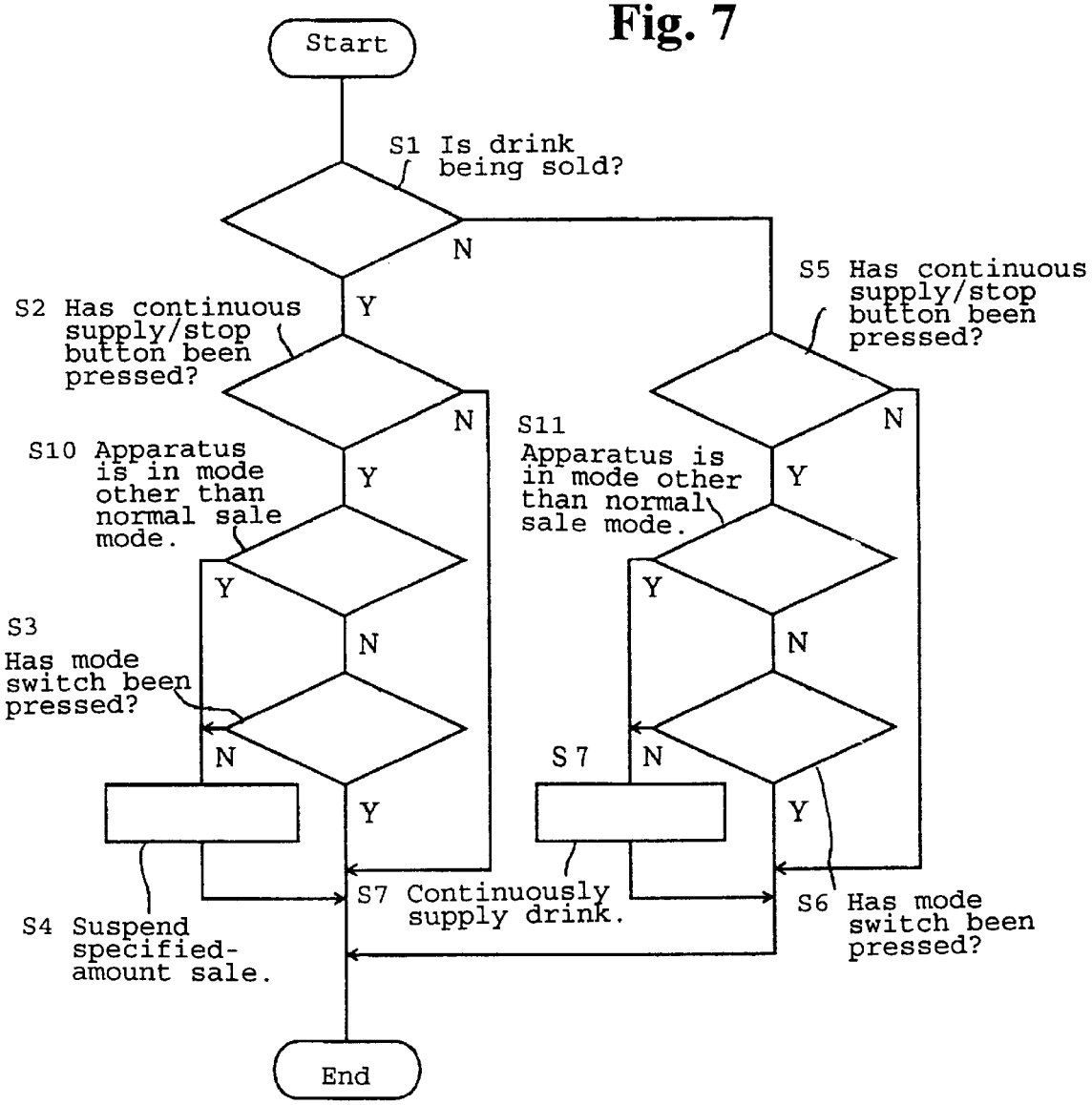
FIG. 7 is a flowchart showing the operation of the fifth embodiment of the invention.

Fifth Embodiment of the Invention shown in FIG. 7

This flowchart is the same as that for the third embodiment of the invention (FIG. 5) except that steps S8 and S9 have been changed to steps S10 and S11. Steps S10 and S11 determine whether the apparatus is in a mode, other than a normal sale mode such as the setting and test of a sale amount, for example, an operation mode for adjusting a mechanical device or discharging water only.

When the continuous supply/stop button 7 is pressed (step S2, branch Y) during the sale of a drink (step S1, branch Y), the CPU determines whether or not the apparatus is in a mode other than the normal sale mode (step S10). If so (branch Y), the specified-amount sale is suspended to enable the apparatus to be adjusted, that is, the request from the continuous supply/stop button 7 is accepted (step S4). Otherwise (branch N), the process proceeds to step S3.

When the continuous supply/stop button 7 is pressed (step S5, branch Y) while no drink is being sold (step S1, branch N), the CPU determines whether or not the apparatus is in a mode other than the normal sale mode (step S11). If so (branch Y), a drink is continuously supplied to enable the apparatus to be adjusted, that is, the request from the continuous supply/stop button 7 is accepted (step S7). Otherwise (branch N), the process proceeds to step S6.

The other operations are the same as in the third embodiment of the invention.

In the above operations, when the apparatus is in the normal sale mode, turning on the mode switch 8 can limit the function of the continuous supply/stop button 7 to prevent any inconveniences caused by any improper operations, as in the third embodiment of the invention. Furthermore, when the apparatus is in a mode other than the normal sale mode, the function of the continuous supply/stop button 7 is enabled no matter whether the mode switch 8 is turned on. Thus, if the user uses the continuous supply/stop button 7 to adjust the apparatus but does not desire to use it during the normal drink sales, the mode switch 8 can be used to avoid switching between the enabled and disabled states of the continuous supply/stop button 7.

Figure 8:
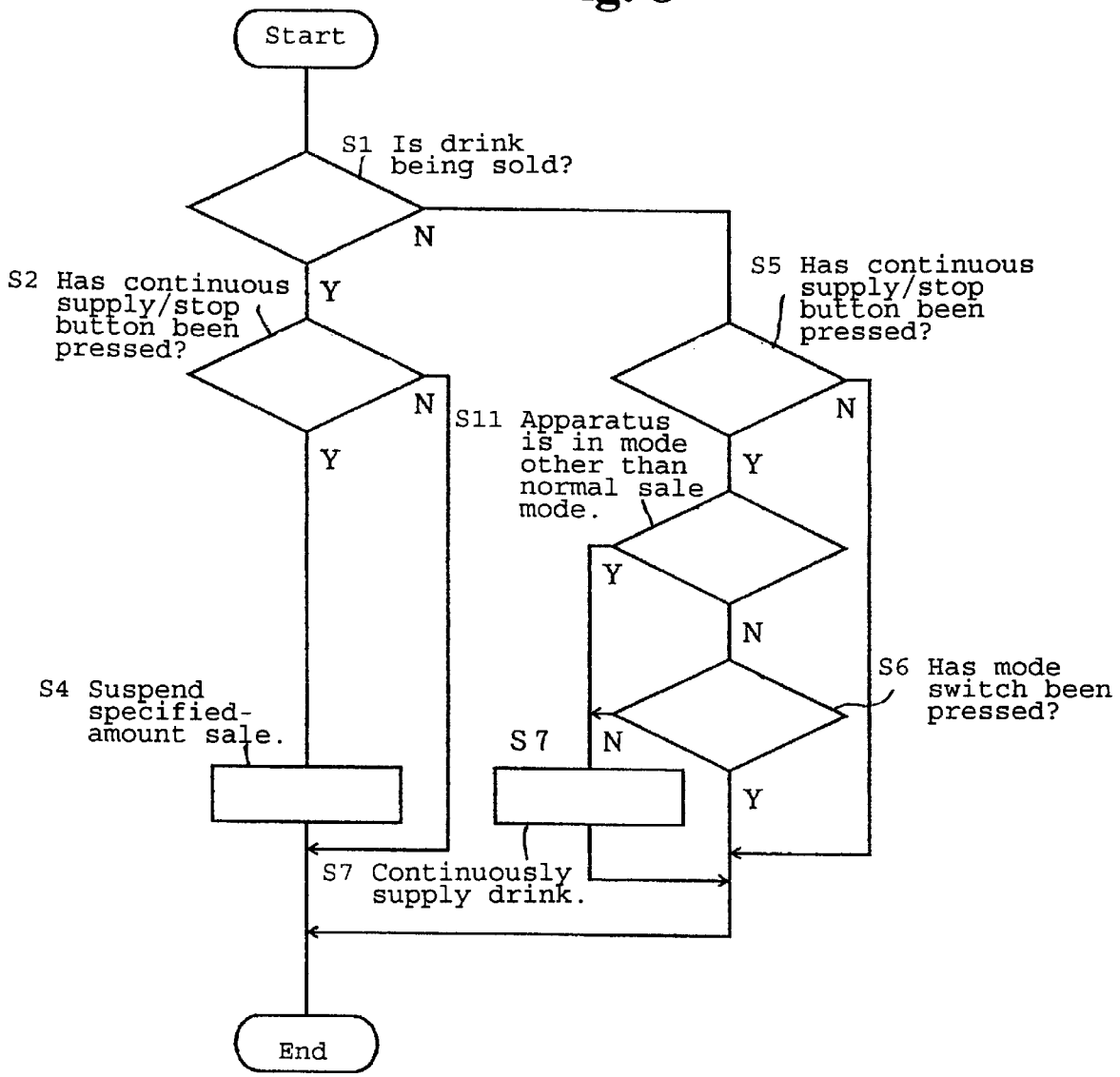
FIG. 8 is a flowchart showing the operation of the sixth embodiment of the invention.

Sixth Embodiment of the Invention shown in FIG. 8

This flowchart is the same as that for the fifth embodiment of the invention (FIG. 7) except that steps S10 and S3 have been omitted.

When the continuous supply/stop button 7 is pressed (step S2, branch Y) during the sale of a drink (step S1, branch Y), the specified-amount sale is suspended immediately (step S4), that is, the request from the continuous supply/stop button 7 is accepted no matter whether the mode switch 8 is turned on. The other operations are the same as in the fifth embodiment of the invention.

In the above operations, turning the mode switch 8 on can invalidate a request from the continuous supply/stop button 7 for continuous supply issued while no drink is being sold and when the apparatus is in the normal sale mode, and can always accept a request from the same button for the suspension of the specified-amount sale issued during that sale. Thus, for example, when the user has mistakenly pressed a specified-amount sale button different from the button corresponding to the desired type of drink and desires to suspend the sale of the drink immediately, the discharge of the drink can be suspended by pressing the continuous supply/stop button. This operation also prevents the continuous supply of a drink caused by any improper operation while no drink is being sold.

As described above, this invention provides a function for disabling a request from the continuous supply/stop button of the suspension of a sale or a continuous supply depending on the conditions of the set mode or the normal sale mode that are in effect when the continuous supply/stop button is pressed. This configuration limits the function of the continuous supply/stop button to prevent any improper operations.

In addition, the enabled and disabled states of the switch can be changed by the sale mode of the drink dispenser. Therefore, if the user frequently uses the continuous supply/stop button to set the specified amount of a drink but does not desire to use it during the normal sales, this invention avoids switching between the enabled and disabled states of the button, thereby improving the operability and effectiveness of the button.

What is claimed is:

1. A drink dispenser for selling a specified amount of a drink, comprising:

drink sale instruction means actuated by a user for selecting a type of a drink and instructing its sale;

sale detector means for detecting whether a drink started to sell by actuation of the drink sale instruction means is being sold;

continuous supply/stop requestor means for requesting a sale of a drink to be suspended when it is operated during the sale and requesting a drink to be continuously supplied when it is operated while no drink is being sold, said requestor means being electrically connected to the sale detector means;

drink supply means for selecting one of a step of suspending the sale of a drink and a step of continuously supplying a drink, upon a request from the continuous supply/stop requestor means, said drink supply means being electrically connected to the requester means; and switch means for determining whether a request from the continuous supply/stop requestor means is to be invalidated, said switch means being electrically connected to the requester means so that when the continuous supply/stop requestor means issues a request, acceptance of the request is determined based on the switch means.

2. A drink dispenser according to claim 1, wherein when the continuous supply/stop requestor means issues the request, if the switch means is on, the request is not accepted.

3. A drink dispenser according to claim 1, wherein when the continuous supply/stop requestor means issues a request during the sale of a drink, the request is accepted regardless of a condition of the switch means.

4. A drink dispenser according to claim 3, wherein when the continuous supply/stop requestor means issues a request while no drink is being sold, the request is not accepted if the switch means is on.

5. A drink dispenser according to claim 4, further comprising mode detector means for detecting whether the dispenser is in a mode other than a normal sale mode.

6. A drink dispenser according to claim 5, wherein when the continuous supply/stop requestor means issues the request, the request is not accepted if the dispenser is in the normal sale mode and the switch means is on.

7. A drink dispenser according to claim 6, wherein when the continuous supply/stop requestor means issues the request, the request is accepted if the dispenser is in a mode other than the normal sale mode.

8. A drink dispenser according to claim 5, wherein when the continuous supply/stop requestor means issues a request during the sale of a drink, the request is accepted regardless of conditions of the switch means and the normal sale mode.

9. A drink dispenser according to claim 8, wherein when the continuous supply/stop requester means issues a request while no drink is being sold, the request is not accepted if the dispenser is in the normal sale mode and the switch means is on.

10. A drink dispenser according to claim 1, further comprising set mode detector means for detecting whether the dispenser is in a set mode.

11. A drink dispenser according to claim 10, wherein when the continuous supply/stop requestor means issues the request, the request is not accepted if the dispenser is not in the set mode and the switch means is on.

12. A drink dispenser according to claim 11, wherein when the continuous supply/stop requestor means issues the request, the request is accepted if the dispenser is in the set mode.

13. A drink dispenser according to claim 10, wherein when the continuous supply/stop requester means issues a request during the sale of a drink, the request is accepted regardless of conditions of the switch means and the set mode.

14. A drink dispenser according to claim 13, wherein when the continuous supply/stop requestor means issues a request while no drink is being sold, the request is not accepted if the dispenser is not in the set mode and the switch means is on.

15. A drink dispenser according to claim 1, wherein said switch means changes an operation condition of the continuous supply/stop requestor means when the continuous supply/stop requestor means is actuated.

* * * * *